US005207339A

United States Patent [19]

Shyu

[11] Patent Number: 5,207,339

[45] Date of Patent: May 4, 1993

[54] BOTTLE CAP ASSEMBLY

[76] Inventor: Wen-Ben Shyu, 2F, No. 331, Sec. 2, Ne Hu Rd., Taipei, Taiwan

[21] Appl. No.: 880,372

[22] Filed: May 8, 1992

[51] Int. Cl.[5] ..... B65D 51/16

[52] U.S. Cl. ..... 215/228; 215/309; 215/311; 215/260; 141/65

[58] Field of Search ..... 215/228, 309, 311, 260; 141/64, 25, 26, 27, 65

[56] References Cited

U.S. PATENT DOCUMENTS

| | | | |
|---|---|---|---|
| 3,602,387 | 8/1971 | Patnaude | 215/311 X |
| 4,033,091 | 7/1977 | Saponara | 215/228 X |
| 4,524,877 | 6/1985 | Saxby et al. | 215/228 |
| 4,640,426 | 2/1987 | Wasley | 215/228 |
| 4,763,802 | 8/1988 | Johnston | 215/228 |
| 4,763,803 | 8/1988 | Schneider | 215/228 X |
| 4,768,665 | 9/1988 | Ballas | 215/228 |
| 4,823,968 | 4/1989 | Handzlik | 215/228 |
| 4,889,250 | 12/1989 | Beyer | 215/228 |
| 4,911,314 | 3/1990 | Schneider | 215/228 |
| 5,031,785 | 7/1991 | Lemme | 215/228 |

*Primary Examiner*—Allan N. Shoap
*Assistant Examiner*—Paul Schwarz
*Attorney, Agent, or Firm*—Lowe, Price, LeBlanc & Becker

[57] ABSTRACT

A bottle cap assembly it is described which includes a hollow cylindrical body adapted to be fastened to the neck of a soda water bottle to seal the top opening thereof, a valve seat having valves to seal an outlet hole on the hollow cylindrical body, a division plate to hold said valve seat in place, a cap retained on said hollow cylindrical body and a bellows within said body retained by the cap. The device functions when the cap is pressed which causes outside air to be compressed and fed into the soda water container to pressurize the same. A release of the cap causes an expansion of the bellows which readmits outside air into the bellows without releasing the contents of the soda water bottle.

1 Claim, 6 Drawing Sheets

BOTTLE CAP ASSEMBLY

BACKGROUND OF THE INVENTION

The present invention relates to bottle caps, and more particularly, the present invention relates to a bottle cap assembly for sealing a bottled soda water or the like to keep its original taste fresh.

Soda water is a beverage consisting of water highly charged with carbon dioxide. If most carbon dioxide escaped from a bottled soda water, the original taste of the soda water becomes lost. Therefore, the container of a soda water should be well sealed. However, the cap of a soda water container can not completely seal the container again without letting carbon dioxide escape from the soda water once it has been uncapped.

SUMMARY OF THE INVENTION

The present invention has been accomplished to eliminate the aforesaid problem. It is therefore the main object of the present invention to provide a bottle cap assembly for sealing a soda water container which can effectively prohibit a soda water from releasing carbon dioxide. According to the preferred embodiment, a bottle cap assembly comprises a hollow cylindrical body fastened to the neck of a soda water bottle to seal the top opening thereof, a valve seat having valves to seal an outlet hole on the hollow cylindrical body, a division plate to hold the valve seat in place, a press cap retained to the hollow cylindrical body to hold a bellows pipe, wherein pressing the press cap causes an outside current of air to be compressed into the soda water container onto which the bottle cap assembly is sealed, so as to prohibit the soda water, which is contained in the soda water container, from releasing carbon dioxide.

DETAILED DESCRIPTION OF THE PREFERRED EMBODIMENT

Figure 1:
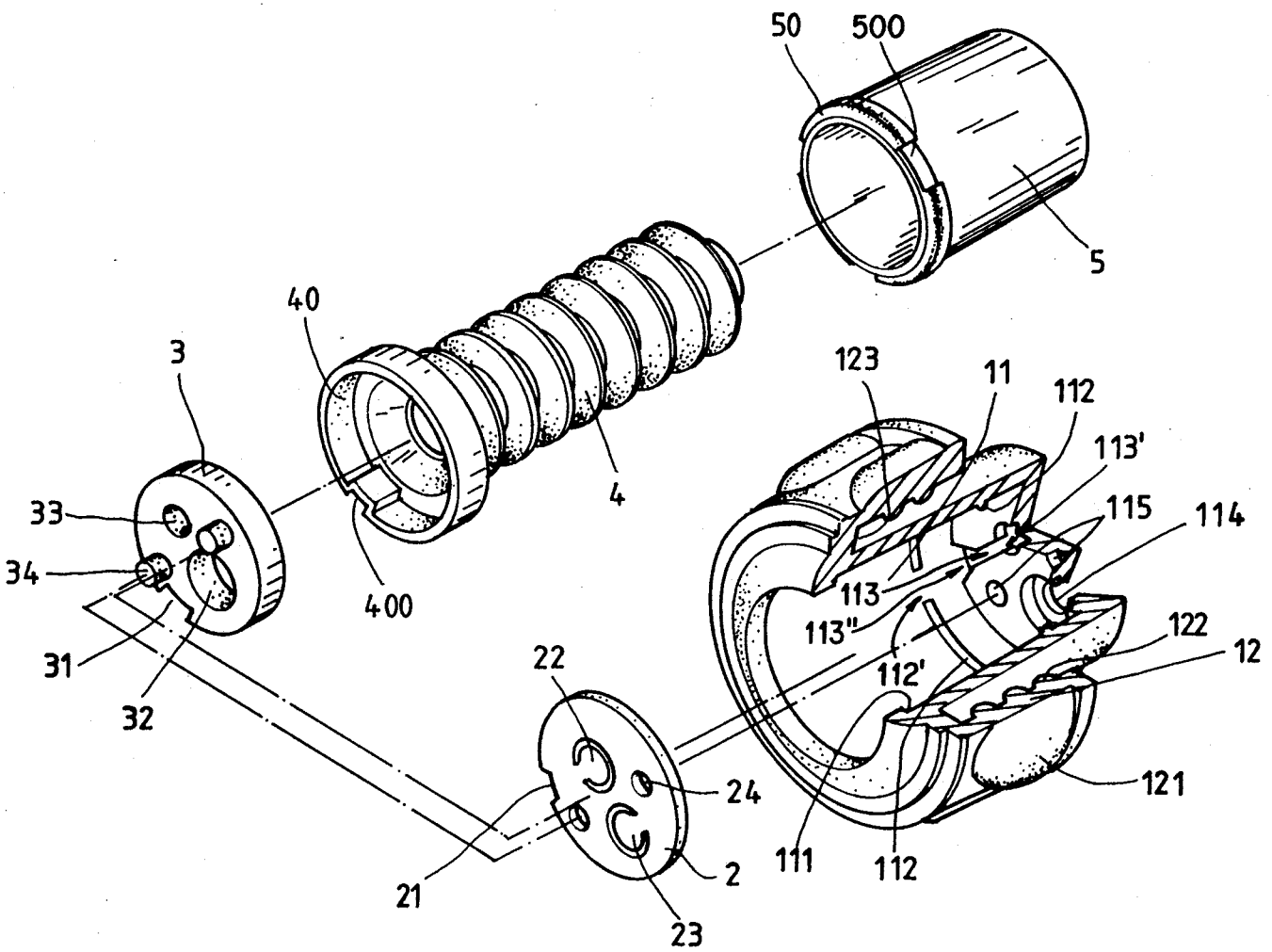
FIG. 1 is an exploded view of the preferred embodiment of the bottle cap assembly of the present invention.
Figure 2:
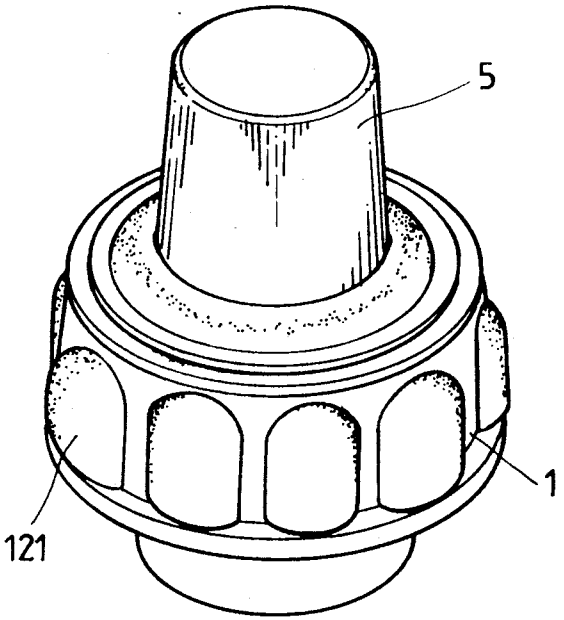
FIG. 2 is an elevational view thereof.

Referring to FIGS. 1 and 2, the preferred embodiment of the bottle cap assembly of the present invention is generally comprised of a body 1, a valve seat 2, an upper division board 3, a bellows pipe 4 and a press cap 5.

The body 1 is comprised of a hollow cylinder 11 covered with an outer shell 12. The hollow cylinder 11 of the body 1 comprises an inward circular flange 111 around the inside surface of the opened top end thereof, a locating flange 112 around the inside surface near the closed bottom end thereof, an elongated groove 113 on the inside surface of the closed bottom end thereof, which elongated groove 113 has one end formed into a circular recess 113' and an opposite end formed into a triangular recess 113', an outlet hole 114 through the closed bottom end thereof, and two opposite locating holes 115 on the closed bottom end thereof. The outer shell 12 of the body 1 comprises a plurality of raised portions 121 spaced around the peripheral outside surface thereof for comfortable and positive grip, an inner thread 122 spaced from the outside surface of the hollow cylinder 11 by a recessed locating groove 123.

The valve seat 2 is made from an elastic round plate fitting into the inner diameter of the hollow cylinder 11, comprising two opposite through holes 24, two flaps made through the process of punching and formed into an intake check valve 22 and an outlet check valve 23, and a side notch 21.

The upper division board 3 is made from a thicker round plate having two opposite pins 34 vertically extended from the bottom edge thereof, a big intake hole 32, a small outlet hole 33, and a side notch 31.

The bellows pipe 4 comprises an expanded circular bottom flange 40, which receives the upper division board 3, having a recessed portion 400 on the peripheral edge thereof for the positioning of the side notch 31 of the upper division board 3.

The press cap 5 is made in the shape of a cylinder having a circular flange 50 on the outside surface around the opened bottom edge thereof, which circular flange 50 is punched with a plurality of spaced air holes 500.

Figure 3:
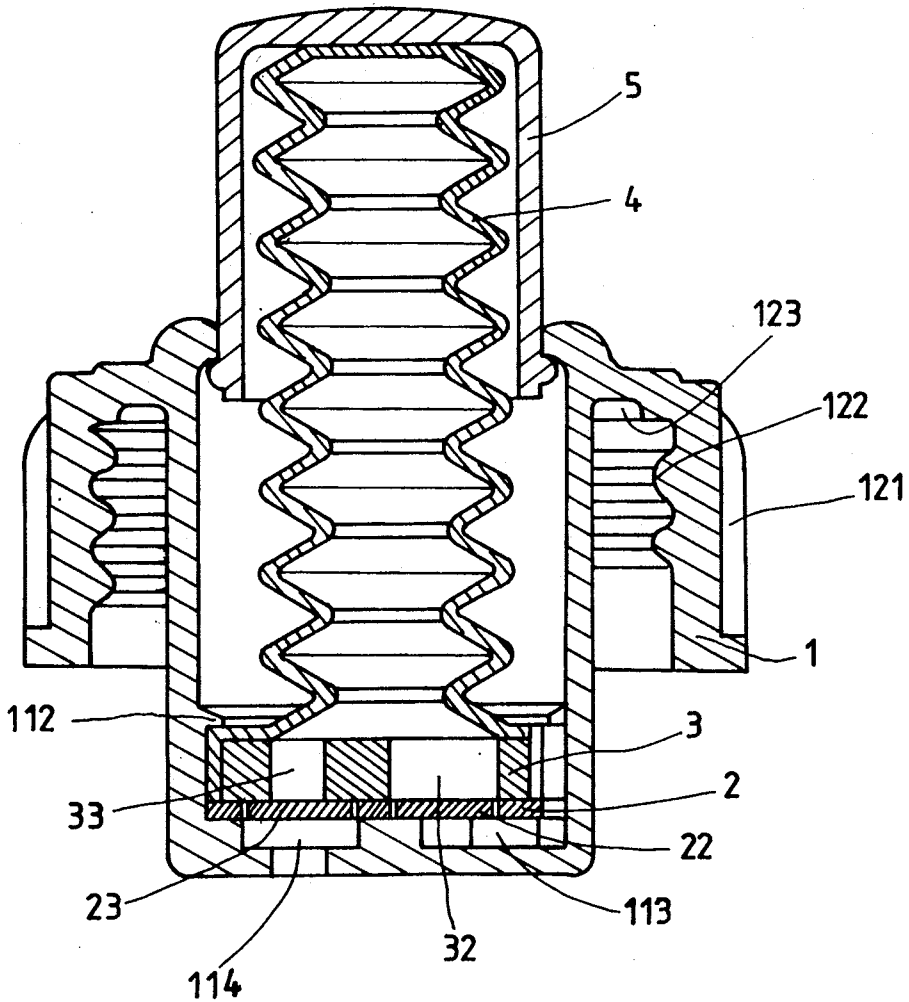
FIG. 3 is a longitudinal cross section thereof.

The assembly process of the present invention is outlined hereinafter with reference to FIG. 3. The press cap 5 is inserted into the hollow cylinder 11 of the body 1 with the circular flange 50 stopped against the inward circular flange 111 of the hollow cylinder 11 of the body 1 on the inside, permitting the valve seat 2, the upper division board 3 and the bellows pipe 4 to be properly received in therebetween. When assembled, the top end of the bellows pipe 4 is stopped at the closed top edge of the press cap 5, and the circular flange 40 thereof is stopped at the closed bottom edge of the hollow cylinder 11 and retained by the locating flange 112 over the elongated groove 113. The upper division board 3 is received inside the circular flange 40 and retained below the locating flange 112 with the side notch 31 thereof receiving to the recessed portion 400, and with the two opposite pins 34 thereof respectively inserted through the two opposite through holes 24 on the valve seat 2 into the two opposite locating holes 115 on the closed bottom edge of the hollow cylinder 111. Therefore, the side notch 31 on the upper division board 3 and the side notch 21 on the valve seat 2 are disposed in line with the recessed sector of the elongated groove 113.

Figure 4:
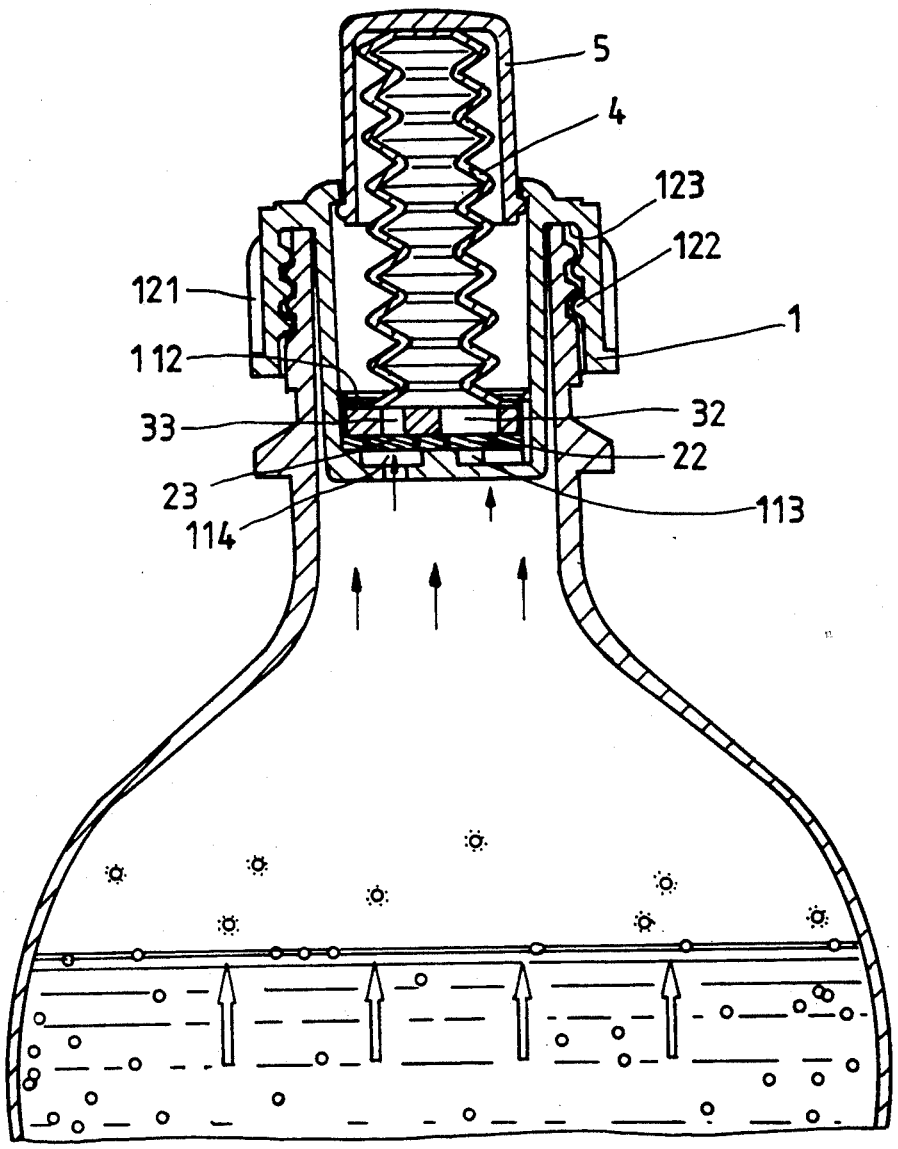
FIG. 4 is a sectional view showing that the bottle cap assembly has been fastened to a bottle to seal the opening thereof.
Figure 5:
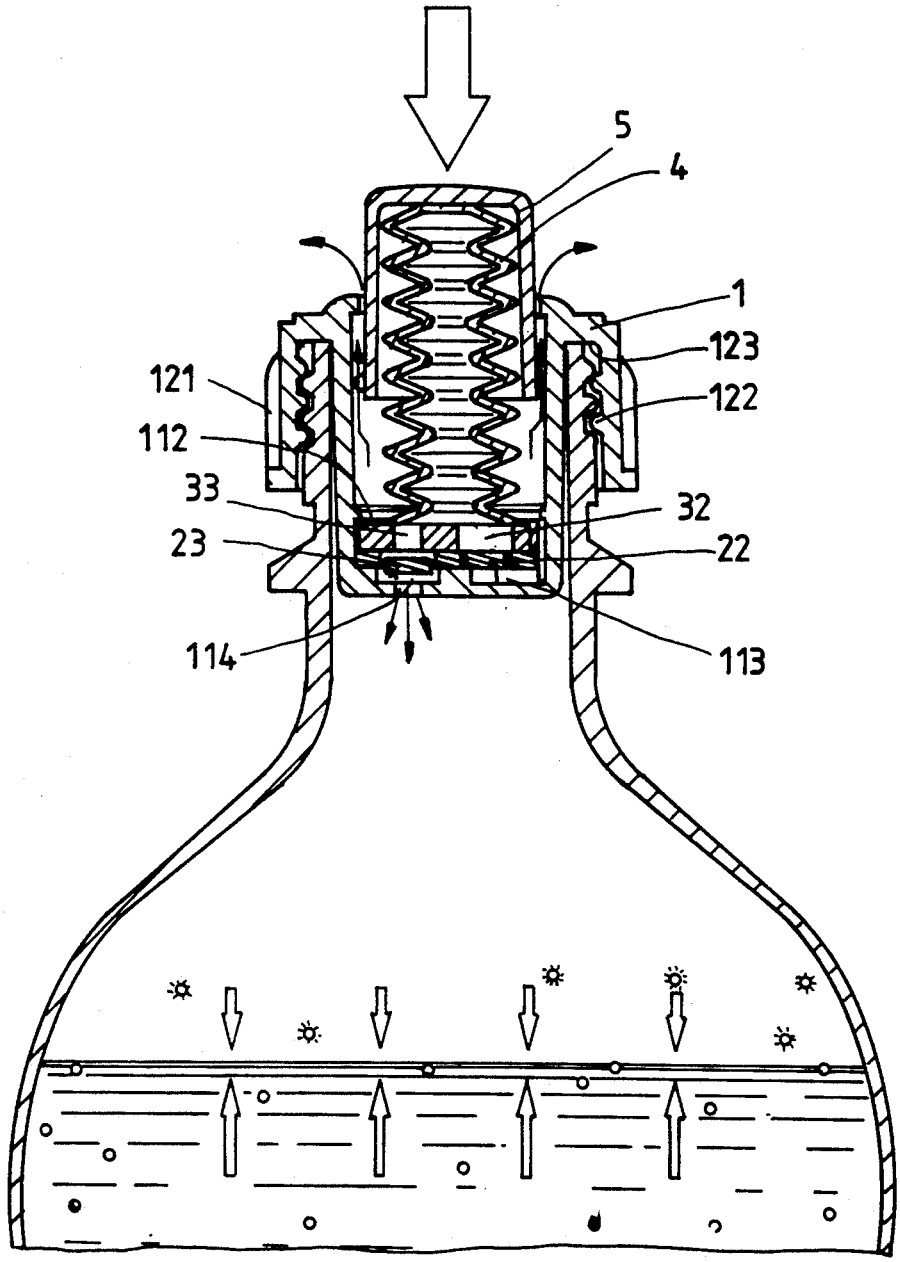
FIG. 5 is another sectional view showing that the press cap is pressed downwards to compress outside air into the bottle.
Figure 6:
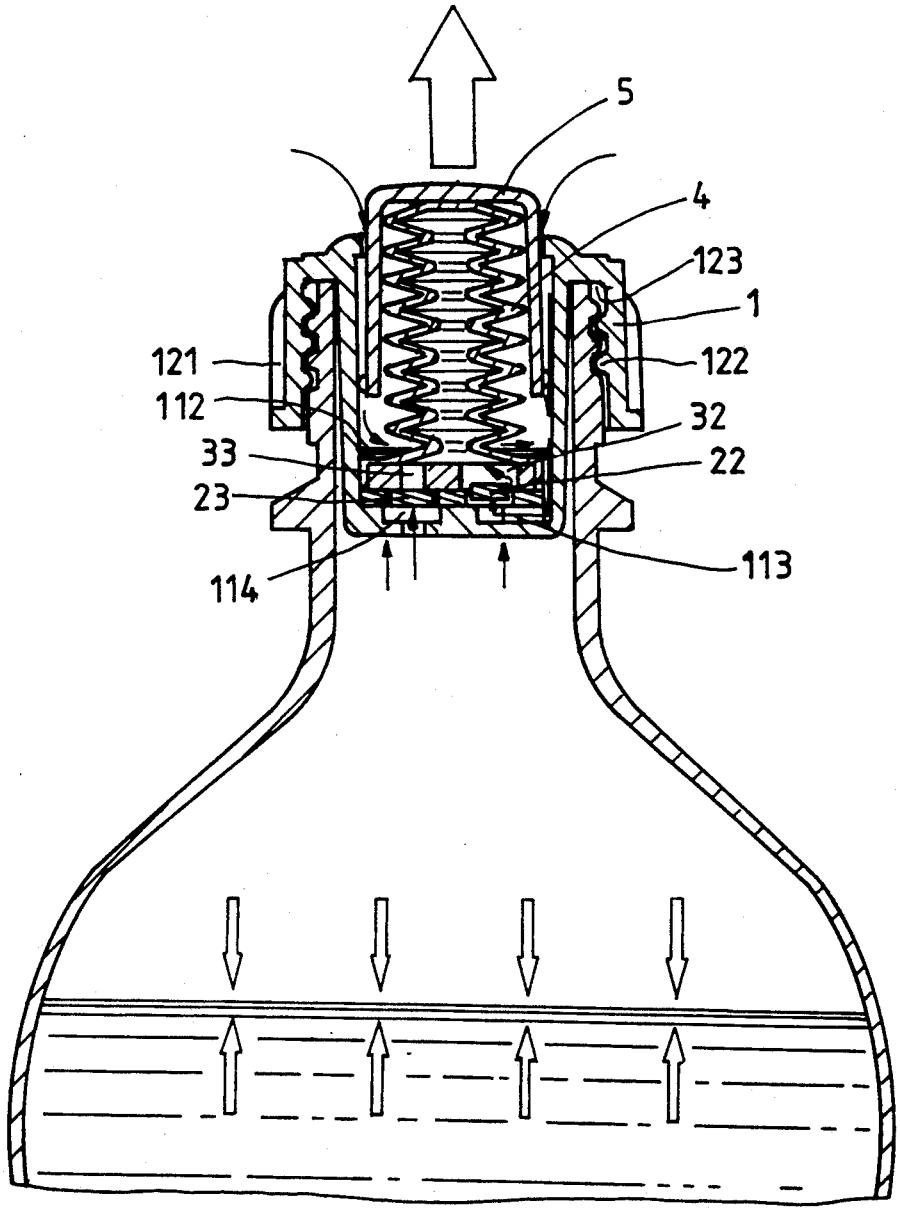
FIG. 6 is still another sectional view showing that releasing the press cap causes the bellows pipe to return into its original shape in pushing the press cap back to its original position.

The operation of the present invention is outlined hereinafter with reference to FIGS. 4, 5 and 6. The cap assembly is fastened to the neck of the bottle of a bottled soda water to be sealed by inserting the neck of the bottle into the recessed locating groove 123 between the hollow cylinder 11 and the outer shell 12 permitting the inner thread 122 to be tightly meshed with the outer thread on the neck of the bottle. When fastened, the outlet check valve 23 seals up the outlet hole 114 to prohibit internal air from escaping out of the bottle through the cap assembly. Under this condition, the internal air pressure above the soda water is still approximately equal to atmospheric pressure, therefore carbon dioxide is gradually releasing from the soda water (see FIG. 4). Continuously pressing the press cap 5 causes the bellows pipe 4 to be compressed in reducing its holding space and increasing its internal air pressure. Increasing the air pressure inside the bellows pipe 4 causes the intake check valve 22 to be tightly attached to the elongated groove 113 in prohibiting internal air from escaping out of the bottle through the cap assembly 1. When the air pressure inside the bellows pipe 4 exceeded the pressure which is born by the outlet valve 23 from the released carbon dioxide, a compressed air is squeezed into the bottle, at the same time, the air in the space outside the bellows pipe 4 within the hollow cylinder 11 is squeezed out of the cap assembly through the air holes 500 and the gap between the press cap 5 and the body 1 (see FIG. 5). Once the press cap 5 has been pressed to the bottom limit, the internal pressure inside the bottle is greatly increased, and therefore little carbon dioxide is released from the soda water. Once the press cap 5 has been released from the hand, the bellows pipe 4 automatically returns to its original shape in pushing the press cap 5 back to its original position. When the holding space inside the bellows pipe 4 is increasing, the air pressure inside the bellows pipe 4 is relatively reducing, causing an outside current of air to enter through the gap between the body 1 and the press cap 5 and the air holes 500 on the press cap 5, the outside space of the recessed portion 400 and the elongated groove 113, to open the intake check valve 22 so as to enter the holding space inside the bellows pipe 4. At the same time, the outlet check valve 23 is forced to seal the outlet hole 114 in prohibiting the compressed inside air of the bottle from escaping through the cap assembly. As soon as the bellows pipe 4 has been completely returned to its original shape, it can be squeezed by the press cap 5 again, to compress the air inside the bottle. By repeating the aforesaid procedure, the internal air inside the bottle is compressed to almost completely prohibit the soda water from releasing carbon dioxide, and therefore, the taste of the soda water in the bottle is maintained (see FIG. 6).

It will be obvious to those skilled in the art that various modifications can be made without departing from the basic teaching of the present invention. For example, by changing the size and shape of the outer shell and the body of the bottle cap assembly, the present invention can be used in sealing any of a variety of beverage containers including glass bottles and easy-openers.

As indicated, the present invention is to provide a cap assembly for sealing the bottle of a bottled soda water or the like to prohibit the bottled soda water or the like from relating carbon dioxide, and therefore, the original taste of the bottled soda water or the like is maintained.

What is claimed is:

1. A bottled cap assembly for a soda water container having an open top with at least one outer thread surrounding said opening comprising:

a body, said body comprised of a hollow cylinder having an open and a closed end covered with an outer shell, said hollow cylinder having an inward circular flange surrounding the inside surface adjacent the open end thereof, a locating flange surrounding said inside surface adjacent the closed end thereof, an elongated groove on an inside surface of said closed bottom end, said elongated groove having one end formed into a circular recess and an opposite end formed into a triangular sector, an outlet hole formed through said closed bottom end, and two opposite locating holes on the inside surface of said closed bottom end, said outer shell having a plurality of raised portions around the outside surface thereof for comfortable and positive grip, an inner thread spaced from said outside surface of said hollow cylinder and a recessed locating groove, said inner thread being adapted to engage an outer thread on a soda water container to be sealed, said recessed locating groove being adapted to receive the top opening and thread of the soda water container to be sealed;

a valve seat received in said hollow cylinder and retained between said locating flange and the closed end thereof, said valve seat having two holes in alignment with the two opposite locating holes on the closed end of said hollow cylinder, an intake check valve adapted to seal the elongated groove on the closed bottom and of said hollow cylinder, and outlet check valve to seal the outlet hole on the closed bottom end of said hollow cylinder, and a side notch aligned with said triangular sector of said groove;

an upper division board received in said hollow cylinder between said locating flange and said valve seat, said upper division board having two bottom pins respectively inserted through the two holes on said valve seat and into the two opposite location holes in the closed end of said hollow cylinder, an intake hole aligned with said intake check valve and an outlet hole aligned with said outlet check valve, and a side notch aligned with the side notch on said valve seat;

a bellows received in said hollow cylinder, said bellows having an expanded circular bottom flange, which receives said upper division board and is disposed between said locating flange and valve seat, said expanded circular bottom flange of said bellows having a recessed portion received in the inside notch on said upper board;

a cap slidably secured in the open end of said hollow cylinder and receiving said bellows, said cap having a circular flange retained by the inward circular flange adjacent the open end of said hollow cylinder, the circular flange of said press cap having spaced air holes therethrough;

whereby pressing said cap causes an outside current of air to be compressed into the soda water container onto which the cap assembly is seated, so as to prohibit the soda water, which is contained in said soda water container, from releasing carbon dioxide.

* * * * *